US011143370B2

(12) United States Patent
De Goederen-Oei et al.

(10) Patent No.: US 11,143,370 B2
(45) Date of Patent: Oct. 12, 2021

(54) LIGHT POLE

(71) Applicant: SIGNIFY HOLDING B.V., Eindhoven (NL)

(72) Inventors: Ay Ling De Goederen-Oei, Best (NL); Koos Van Oorschot, Eindhoven (NL); Alouisius Johannes Gerardus Maria Willemse, Eindhoven (NL); Kevin Spall, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/255,474

(22) PCT Filed: Jun. 25, 2019

(86) PCT No.: PCT/EP2019/066894
§ 371 (c)(1),
(2) Date: Dec. 23, 2020

(87) PCT Pub. No.: WO2020/002363
PCT Pub. Date: Jan. 2, 2020

(65) Prior Publication Data

US 2021/0215307 A1 Jul. 15, 2021

Related U.S. Application Data

(60) Provisional application No. 62/691,002, filed on Jun. 28, 2018.

(30) Foreign Application Priority Data

Aug. 14, 2018 (EP) ..... 18188976

(51) Int. Cl.
*F21S 8/08* (2006.01)
*E04H 12/08* (2006.01)
(Continued)

(52) U.S. Cl.
CPC ..... *F21S 8/08* (2013.01); *E04H 12/085* (2013.01); *F21S 8/085* (2013.01); *F21V 21/10* (2013.01); *F21W 2131/103* (2013.01)

(58) Field of Classification Search
CPC ..... E04H 12/085; F21S 8/085; F21S 8/086; F21S 8/088; F21W 2131/103
See application file for complete search history.

(56) References Cited

U.S. PATENT DOCUMENTS 5,673,886 A 10/1997 Negishi
2010/0050568 A1 3/2010 Griffiths
(Continued)

FOREIGN PATENT DOCUMENTS

EP 3342961 B1 1/2020
JP H06162814 A 6/1994
(Continued)

*Primary Examiner* — Sean P Gramling

(57) ABSTRACT

A light pole (100), wherein the light pole extends along a principal axis, A. The light pole comprises a housing (110) extending along the principal axis, and a support structure (120) arranged within the housing. The support structure comprises a board-shaped segment (130) extending along the principal axis, and flanges (140*a*, 140*b*) extending along the principal axis and arranged on either, longitudinal side of the segment. The flanges, in a cross-section of the support structure perpendicular to the principal axis, extend in a plane perpendicular to the principal axis. The length, L, of the flanges in said plane is larger at respective end portions (150*a*, 150*b*) of the support structure than at a central portion (160) of the support structure along the principal axis.

10 Claims, 4 Drawing Sheets

(51) Int. Cl.
*F21V 21/10* (2006.01)
*F21W 131/103* (2006.01)

(56) References Cited

U.S. PATENT DOCUMENTS

| | | | | |
|---|---|---|---|---|
| 2014/0247542 | A1 | 9/2014 | Fong et al. | |
| 2020/0103085 | A1* | 4/2020 | Chia | F21V 21/10 |

FOREIGN PATENT DOCUMENTS

| | | | |
|---|---|---|---|
| NL | 1033304 | C2 | 7/2008 |
| WO | 2018114495 | A1 | 6/2018 |
| WO | 2018114510 | A1 | 6/2018 |

* cited by examiner

LIGHT POLE

CROSS-REFERENCE TO PRIOR APPLICATIONS

This application is the U.S. National Phase application under 35 U.S.C. § 371 of International Application No. PCT/EP2019/066894, filed on Jun. 25, 2019, which claims the benefit of U.S. Provisional Patent Application No. 62/691,002, filed on Jun. 28, 2018, and European Patent Application No. 18188976.7, filed on Aug. 14, 2018. These applications are hereby incorporated by reference herein.

FIELD OF THE INVENTION

The present invention generally relates to the field of light poles. More specifically, the present invention relates to light poles which are intended to comprise telecommunication equipment for a wireless telecommunication functionality.

BACKGROUND OF THE INVENTION

The digital transformation of urban spaces and the adoption of 'smart' city services accelerates in today's society. As an example of this development, several companies are currently developing collocation ready, 4G/5G enabled LED smart light poles for use in roadways, streets and parking lots that will improve wireless broadband access in dense urban areas while also providing quality energy-efficient connected LED lighting. More specifically, telecommunication equipment comprising e.g. radios, antennas, cables, etc., is integrated in the light poles with the purpose of providing telecommunication functionality while obscuring the equipment from public view and/or tampering.

Typically, a light pole of this kind may comprise, from the bottom and up, a base portion for housing a telecommunication equipment that generates, processes and receives radio signals, a mid-portion having a predetermined length in order to achieve a desired height of the light pole, an antenna section for carrying the mechanical load of the part that are mounted above the antenna section (e.g. luminaires, spigots, arms, etc.) and which provides functionality to assemble variation of antenna-configurations, and a luminaire portion which may comprise one or more luminaires.

As the capacity of a single telecommunication radio and antenna is rather limited, there is a need to use one or more radios with a higher radio throughput and/or the possibility of adding more radios and antennas that communicate over different parts of the radio spectrum. Consequently, there is a desire to also include more radios in the base portion of the light pole, which has the result that the size of this enclosure increases. In addition to this, there is also a need to densify the number of locations with telecommunications functionality (so called 'call sites'), which is mainly due to the fact that the frequencies available for high data rate transmission need to be operated at smaller distances between the site and the end-customer. This trend is called network densification. As all of these sites need to be included in the city landscape, a light pole as previously described is increasingly being considered by telecommunication operators to locate their sites. Since there are multiple telecom operators which have to densify their network in the same area, the need for suitable locations for sites is growing rapidly. Scarceness of space and restrictions to network densification budgets often drive the network operators to look for solutions where they can share space at a single location with some common utilities being present. A multi-tenancy, 'smart' light pole that offers a location or cell site to multiple operators to provide mobile services independently of each other may hereby provide a solution. As these mobile operators will buy their network equipment from multiple vendors, multi-tenancy in a light pole may add multi-vendor operation to the list of requirements.

For reasons of municipality acceptance, it should be noted that the diameter of the light pole is limited. With the advent of multi-tenancy with multiple vendors, the limited diameter of the pole, the height of the base will give rise to new problems related to strength of the pole-support structure, especially in high wind load zones. A high wind load may act on the entire light pole, and especially if the light pole is equipped with one or more luminaire arms, there may be relatively high torsion forces exerted by the mid portion on the base portion of the light pole. It should be noted that the current state of light pole constructions cannot withstand these kinds of loads without further extending the profile of the light pole construction to increase its strength. However, this is in conflict with the requirement that the enclosure that is created by the profile should still be accessible to install and to service telecommunication equipment.

Hence, alternative solutions are of interest, which are able to provide a strong and resistant light pole for installing and/or housing telecommunication equipment, and which furthermore may provide an easily accessible maintenance of any telecommunication equipment arranged in the light pole.

WO2018/114495A1 discloses a light pole comprising a circular wall around a hollow core as a tubular body part and an H-shaped frame arranged in the core and extending in the axial direction and being connected to the wall.

SUMMARY OF THE INVENTION

It is an object of the present invention to mitigate the above problems and to provide a strong and resistant light pole for installing and/or housing telecommunication equipment, which furthermore may provide an easily accessible maintenance of any telecommunication equipment arranged in the light pole.

This and other objects are achieved by providing a light pole having the features in the independent claim. Preferred embodiments are defined in the dependent claims.

Hence, according to the present invention, there is provided a light pole which extends along a principal axis. The light pole comprises a housing extending along the principal axis, and a support structure arranged within the housing. The support structure comprises a board-shaped segment extending along the principal axis. Furthermore, the support structure comprises flanges extending along the principal axis and arranged on either, longitudinal side of the segment. In a cross-section of the support structure perpendicular to the principal axis, the flanges extend in a plane perpendicular to the principal axis. The length of the flanges in said plane is larger at both end portions of the support structure than at a central portion of the support structure along the principal axis.

Thus, the present invention is based on the idea of providing a strong and 'smart' light pole, which is highly resistant to weather conditions, damage and/or tampering, and which optionally may house pieces of telecommunication equipment for wireless communication. The light pole has a support structure within the (outer) housing of the light pole, wherein the support structure, in a cross-section perpendicular to the principal axis of the light pole, has an H-shape or 'dog-bone' shape. The length or width of the flanges, seen in a cross-section of the support structure perpendicular to the principal axis of the support structure, are longer compared to the length or widths of the flanges at a central portion of the support structure. It will be appreciated that this construction of the light pole results in a relatively strong support structure of the light pole at one end or both ends of the support structure of the light pole. Furthermore, the space(s) defined by the housing and the support structure of the light pole form spaces into which pieces of telecommunication equipment, or the like, may be conveniently accommodated and hidden, obscured and/or protected from weather and/or intended damage, whilst still being easily accessible and/or moved for an operator of the light pole. The present invention is particularly advantageous in that the H-shaped support structure, at a base portion thereof, is able to carry the mechanical load of a mid-section and top section of the light pole. The present invention is further advantageous in that it may provide a modular light pole concept which facilitates manufacturing, transportation and/or installation of the light pole.

The light pole, which extends along a principal axis, comprises a housing and a support structure which are arranged within the housing, wherein the housing and the support structure both extend along the principal axis. The support structure comprises a board-shaped segment extending along the principal axis. By "board-shaped segment", it is here meant that the segment substantially has the shape of a board, a plank, or the like. In other words, the "board-shaped segment" may constitute a relatively flat, elongated segment having a major, long dimension along the principal axis and relatively short, end portions. The support structure in its turn comprises flanges extending along the principal axis and which are arranged along and on either, longitudinal side of the segment. By the term "flanges", it may likewise be meant portions, parts, etc., of the support structure. Seen in a cross-section of the support structure perpendicular to the principal axis, the flanges extend in a plane perpendicular to the principal axis. In other words, the board-shaped segment of the support structure and the flanges together create the shape of a 'H' seen in said cross-section. The length of the flanges in said plane is larger at at least the top portion of the end portions of the support structure than at a central portion of the support structure along the principal axis. Hence, along the principal axis of the support structure, the length of the flanges is larger at the top or both end portions of the support structure compared to a central portion of the support structure.

According to an embodiment of the present invention, the length of the flanges in the plane and at intermediate portions located between the end portions and the central portion along the principal axis, may be smaller than at at least the top portion or at both end portions and at the central portion. In other words, along the principal axis of the support structure, the flanges may have a time-glass shape, wherein the intermediate portions of the flanges may constitute the smaller or thinner 'waist' compared to the larger or wider central and end portion(s) of the flanges.

According to an embodiment of the present invention, the flanges may be curved with respect to the principal axis such that the flanges at least partially enclose the principal axis. Hence, seen in a cross-section of the support structure perpendicular to the principal axis of the support structure, the H-shape of the support structure may be curved concavely with respect to the principal axis. The present embodiment is advantageous in that the support structure, in its cross-section perpendicular to the principal axis, may have a substantially circular, or completely circular support structure, and may be fitted into the housing which correspondingly may have a cylinder shape of substantially circular, or completely circular form in its cross-section. The present embodiment is advantageous in that the support structure may be even stronger and more robust compared to a segment of a H-shape having straight flanges.

According to an embodiment of the present invention, the flanges may be curved such that the flanges, seen in a cross-section of the support structure perpendicular to the principal axis, constitute circular arcs which centers coincide with the principal axis. The length, L, of the circular arcs, seen in a cross-section of the support structure perpendicular to the principal axis, may be $\pi/3 \cdot r < L < \pi \cdot r$, wherein r is the radius of the circular arcs with respect to the principal axis. The present embodiment is advantageous in that this length of the circular arcs may provide a strong light pole, particularly at the end portions of the support structure.

According to an embodiment of the present invention, there may be provided a light pole arrangement. The light pole arrangement may comprise a light pole according to any one of the preceding embodiments. The light pole arrangement may further comprise at least one piece of telecommunication equipment arranged within the housing and at least partially enclosed by the segment and the flanges of the support structure. By the term "telecommunication equipment", it is here meant substantially any kind of equipment which may be needed for substantially any kind of telecommunication operation (e.g. wireless communication), such as one or more antennas, radios, cables, etc. The present embodiment is advantageous in that the light pole arrangement may conveniently house and protect telecommunication equipment whilst providing a highly resistant light pole.

According to an embodiment of the present invention, the housing may comprise at least a base portion and a top portion arranged along the principal axis, and wherein at least a portion of the at least one piece of telecommunication equipment is arranged in the base portion and wherein at least one antenna of the at least one piece of telecommunication equipment is arranged in the top portion. The present embodiment is advantageous in that the antenna(s) of the telecommunication equipment may be provided at a relatively high position in the light pole of the light pole arrangement, which may lead to an improved wireless connectivity.

According to an embodiment of the present invention, the housing may further comprise a mid-portion arranged between the base portion and the top portion, and wherein at least one of the mid-portion and the base portion comprises a first connection for connecting the mid-portion to the base portion. The present embodiment is advantageous in that the light pole arrangement may be provided as a module, which may be conveniently transported and/or assembled.

According to an embodiment of the present invention, the housing may further comprise a foundation arranged below the base portion along the principal axis, and wherein at least one of the foundation and the base portion comprises a second connection for connecting the foundation to the base portion.

According to an embodiment of the present invention, there is provided a streetlight arrangement. The streetlight arrangement may comprise a light pole arrangement according to any of the previously described embodiments, and at least one luminaire arranged at the top portion of the light pole. The present embodiment is advantageous in that the streetlight arrangement may combine the features of distributing light whilst at the same time providing wireless communication via telecommunication equipment arranged within the light pole of the streetlight arrangement.

Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
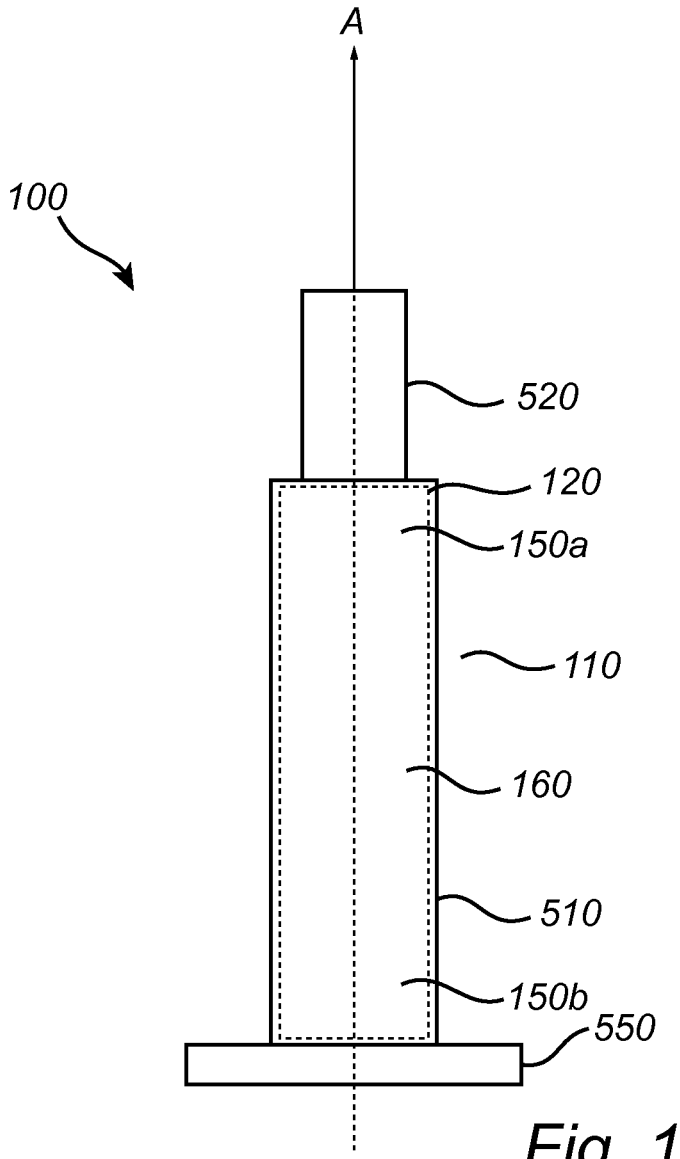
FIG. 1 shows a schematic view of a light pole according to an exemplifying embodiment of the present invention.

FIG. 1 shows a schematic view of a light pole 100 according to an exemplifying embodiment of the present invention. It should be noted that the light pole 100 and/or the elements thereof is not drawn to scale in FIG. 1, which is intended for illustrative purposes only.

The light pole 100 extends along a vertical, principal axis A, and comprises a housing 110 which extends along the principal axis A. The housing 110 may be cylinder-shaped, or alternatively have any other shape, e.g. a rectangular or square cross-section. It will be appreciated that the light pole 100 may be modular, which may facilitate manufacturing, transportation and/or installation of the light pole 100. Here, the housing 110 as exemplified comprises a base portion 510 and a mid-portion 520 arranged along the principal axis A, i.e. the mid-portion 520 is arranged on top of the base portion 510. The mid-portion 520 and/or the base portion 510 may comprise a first connection (not shown) for connecting the mid-portion 520 to the base portion 510. The housing 110 in FIG. 1 further comprises a foundation 550 which is arranged below the base portion 510 with respect to the principal axis A. The foundation 550 and/or the base portion 510 may comprise a second connection (not shown) for connecting the foundation 550 to the base portion 510. As an alternative to the previously described modular concept of the light pole 100, a plurality, or even all parts and components of the light pole 100 may be made in one piece. Hence, the light pole 100 may alternatively be provided as a one-piece, unitary light pole 100.

The light pole 100 further comprises a support structure 120 which is arranged within the base portion 510 of the housing 110. The support structure 120 comprises a central portion 160 and end portions 150*a*, 150*b* at the respective top and bottom portions of the support structure 120 along the principal axis A. It should be noted that the support structure 120 is only schematically indicated in FIG. 1, and the features of the support structure 120 are described in more detail in FIG. 2 and the description thereof.

Figure 2:
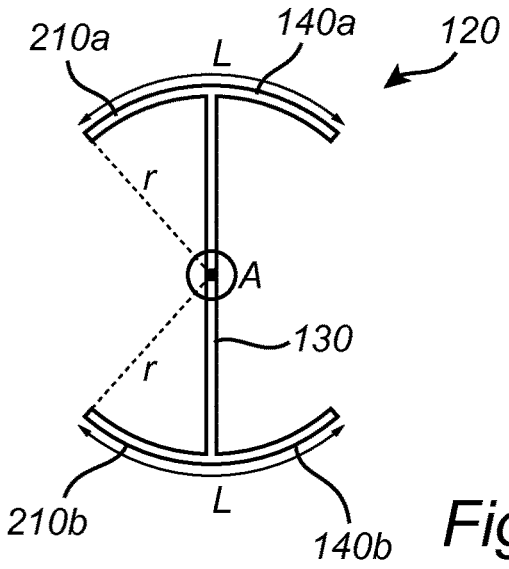
FIGS. 2, 3*a* and 3*b* show schematic views of a support structure of a light pole according to an exemplifying embodiment of the present invention.

FIG. 2 shows a schematic view of a portion of a light pole, e.g. as exemplified in FIG. 1, along the principal axis A normal to the plane of the figures, i.e. towards a viewer. More specifically, FIG. 2 shows the support structure 120 of the light pole according to an exemplifying embodiment of the present invention. The support structure 120 comprises a board-shaped segment 130 which extends along the principal axis A. Hence, as seen in the direction of the principal axis A, the short end of the segment 130 is directed towards the viewer, whereas the long dimension of the plank-shaped or board-shaped segment 130 elongates along the principal axis A. The segment 130 comprises two flanges 140*a*, 140*b* which extend along the principal axis A and which are arranged on either, longitudinal side of the segment 130. It should be noted that the flanges 140*a*, 140*b* may be straight or flat (i.e. not curved), such that the cross-section of the segment 130 perpendicular to the principal axis A has an H-shape. Alternatively, and as shown in FIG. 2, the flanges 140*a*, 140*b* are curved with respect to the principal axis A such that the flanges 140*a*, 140*b* at least partially enclose the principal axis A. Seen in a cross-section of the support structure 120 perpendicular to the principal axis A, the segment 130 and the flanges 140*a*, 140*b* may have a 'dog-bone shape'. More specifically, the flanges 140*a*, 140*b* in FIG. 2 are curved such that the flanges 140*a*, 140*b*, seen in a cross-section of the support structure 120 perpendicular to the principal axis A, constitute circular arcs 210*a*, 210*b* which centers coincide with the principal axis A. The length L of the circular arcs 210*a*, 210*b*, seen in a cross-section of the support structure 120 perpendicular to the principal axis A, may preferably be $\pi r/3 \cdot r < L < \pi \cdot r$, wherein r is the radius of the circular arcs 210*a*, 210*b* with respect to the principal axis A.

Figure 3A:
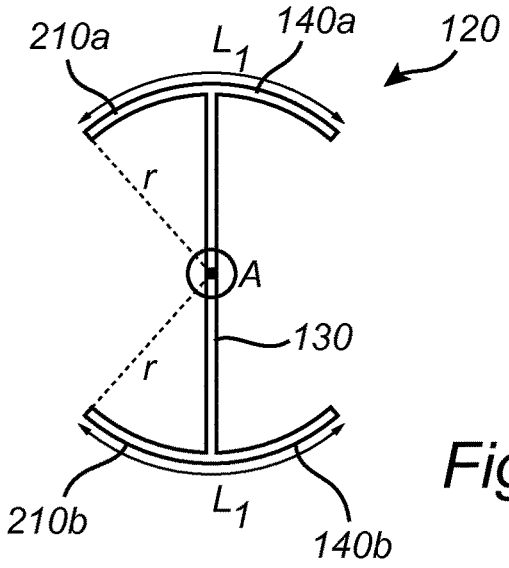
Figure 3B:
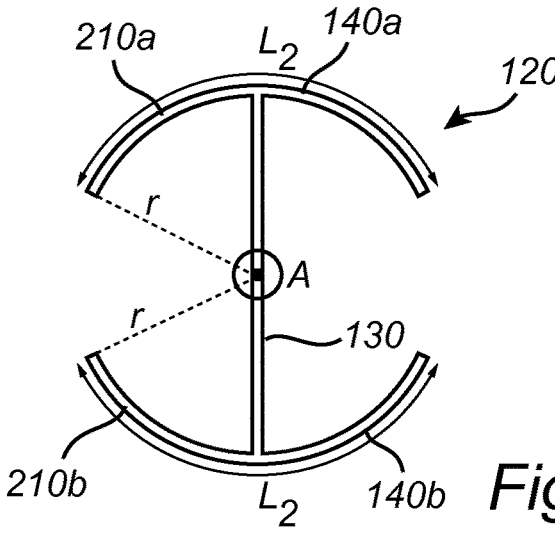

FIGS. 3*a*, 3*b* show schematic views, along the principal axis A, of the support structure 120 of the light pole according to exemplifying embodiments of the present invention. It will be appreciated that the support structure 120 of FIGS. 3*a*, 3*b* has many features in common with the support structure as shown in FIG. 2, and it is hereby also referred to FIG. 2 for an increased understanding.

FIG. 3*a* shows an example of the support structure 120 in a cross-section perpendicular to the principal axis A and at a relatively central portion of the support structure 120 along the principal axis A, e.g. at the central portion 160 of the support structure 120 of the light pole 100 as indicated in FIG. 1. The two flanges 140*a*, 140*b* in FIG. 3*a* are curved such that the flanges 140*a*, 140*b*, seen in a cross-section of the support structure 120 perpendicular to the principal axis A, constitute circular arcs 210*a*, 210*b* which centers coincide with the principal axis A. The length $L_1$ of the circular arcs 210*a*, 210*b*, seen in a cross-section of the support structure 120 perpendicular to the principal axis A, may approximately be $\pi/3 \cdot r < L_1 < 3\pi/5 \cdot r$, such as approximately $\pi/3 \cdot r$, wherein r is the radius of the circular arcs 210*a*, 210*b* with respect to the principal axis A.

Similar to FIG. 3*a*, FIG. 3*b* shows an example of the support structure 120 in a cross-section perpendicular to the principal axis A. However, FIG. 3*b* shows the support structure 120 at one or both of the respective end portions of the support structure 120 along the principal axis A, e.g. at one or both end portions 150*a*, 150*b* of the support structure 120 of the light pole 100 as indicated in FIG. 1. Hence, compared to the length $L_1$ of the flanges 140*a*, 140*b* in FIG. 3*a*, the length $L_2$ of the curved flanges 140*a*, 140*b* in FIG. 3*b* are longer, i.e. $L_2 > L_1$. For example, the length $L_2$ of the circular arcs 210*a*, 210*b* of the flanges 140*a*, 140*b* in FIG. 3*b*, seen in a cross-section of the support structure perpendicular to the principal axis, may approximately be $\pi/2 \cdot r < L_2 < 3\pi/4 \cdot r$, such as approximately $3\pi/5 \cdot r$, wherein r is the radius of the circular arcs 210*a*, 210*b* with respect to the principal axis A. Hence, along the principal axis A of the support structure 120, FIGS. 3*a* and 3*b* indicate that the two flanges 140*a*, 140*b* may have an hour-glass shape. The intermediate or central portions of the flanges 140*a*, 140*b* may constitute the smaller or thinner 'waist' of the hour-glass shape compared to the larger or wider end portion(s) of the flanges 140*a*, 140*b*.

It will be appreciated that the support structure 120 of the light pole 100 as shown in FIGS. 1, 2, 3*a* and/or 3*b* results in a relatively strong support structure 120 of the light pole 100, particularly at one end or both ends of the support structure 120. Furthermore, the housing 110 and the support structure 120 of the light pole 100 form or define spaces. Telecommunication equipment, or the like, may be conveniently accommodated in the spaces, and may be hidden, obscured and/or protected from weather and/or intended damage, whilst still being easily accessible and/or moved for an operator of the light pole 100. The flanges of the support structure 120 are hereby formed or designed such that wind load-forces applied to the light pole can be directed to a foundation of the light pole. Furthermore, by this form or design in combination with a material thickness of approximately 1-2 cm, the light pole may be exposed to winds of up to 60 m/s for a specific pole height.

Figure 4:
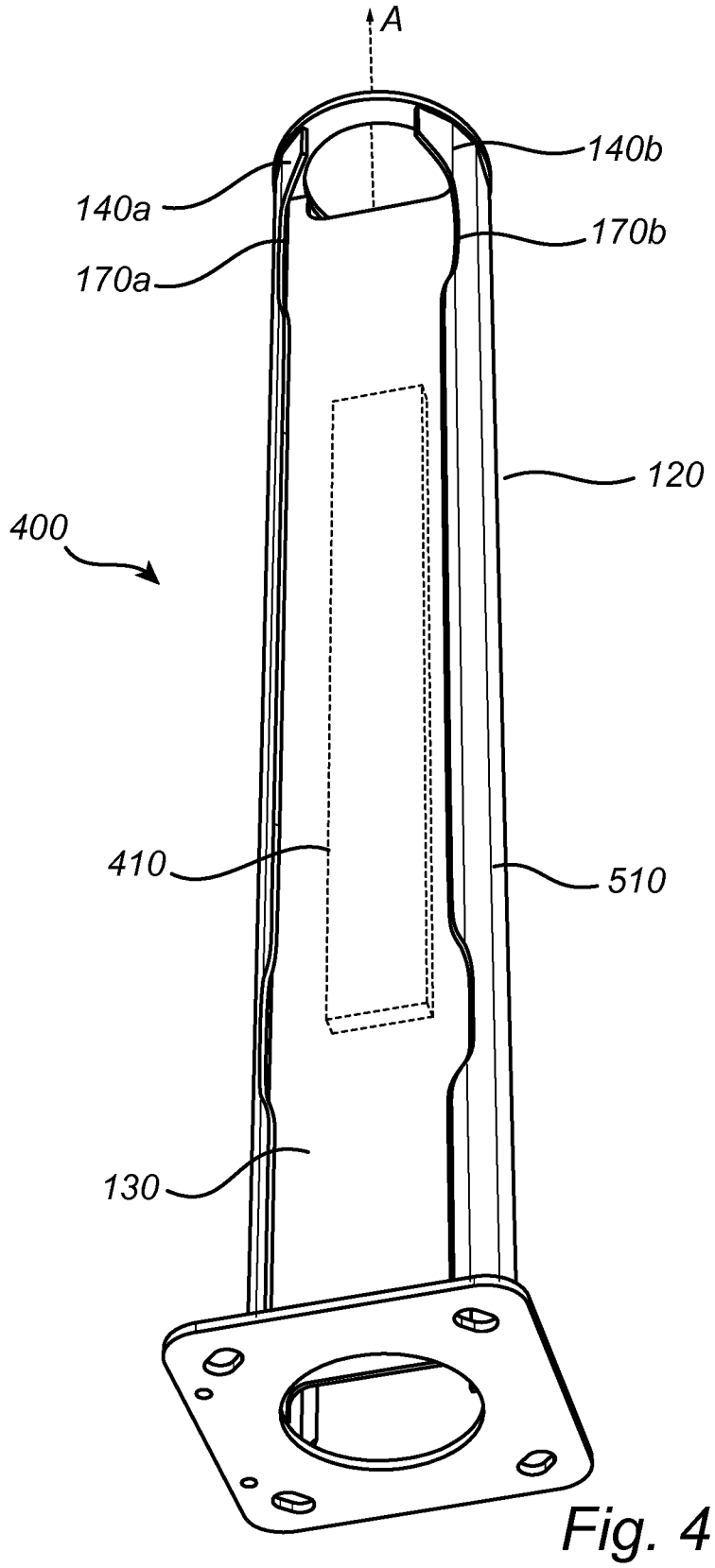
FIG. 4 is a schematic view of a light pole arrangement comprising a light pole according to an exemplifying embodiment of the present invention.

FIG. 4 is a schematic view of a light pole arrangement 400. A base portion 510 of the light pole according to an exemplifying embodiment of the present invention is shown in a perspective view along the principal axis A of the light pole. The support structure 120 of the light pole comprises a board-shaped segment 130 extending along the principal axis A. In correspondence to FIGS. 3*a*, 3*b*, the flanges 140*a*, 140*b* of the support structure 120 are curved and form circular arcs, the centers of which coincide with the principal axis A. The length of the circular arcs of the flanges 140*a*, 140*b*, seen in a cross-section of the support structure 120 perpendicular to the principal axis A, increase from a central portion of the base portion 510 towards an end portion of the base portion 510. The light pole arrangement 400 further comprises one or more parts or pieces of telecommunication equipment 410, as schematically indicated. The equipment 410 is arranged in the space(s) which are at least partially defined by the segment 130 and the flanges 140*a*, 140*b* of the support structure 120 of the light pole.

Figure 5:
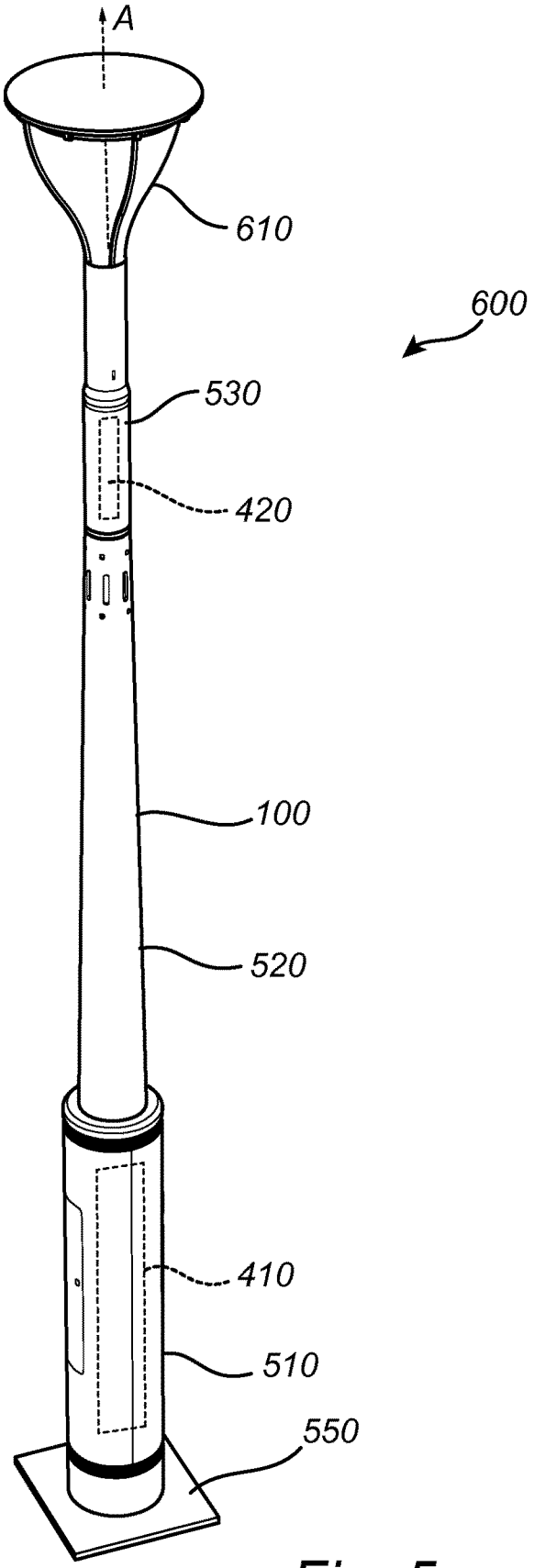
FIG. 5 is a schematic view of a streetlight arrangement comprising a light pole arrangement with a light pole according to an exemplifying embodiment of the present invention.

FIG. 5 is a schematic view of a streetlight arrangement 600 comprising a light pole arrangement with a light pole 100 according to one or more of the previously described examples. The light pole 100 of the streetlight arrangement 600 comprises, along the principal axis A in a direction from the bottom and up, a foundation 550, a base portion 510, a mid-portion 520 and a top portion 530. The streetlight arrangement 600 further comprises a luminaire 610, which in turn may comprise a lighting arrangement comprising one or more LEDs. The luminaire 610 is arranged on the top portion 530 of the light pole 100. In this embodiment of the streetlight arrangement 600, one or more pieces of telecommunication equipment 410 (schematically indicated) is arranged in the base portion 510 of the light pole 100 and at least one antenna 420 (schematically indicated) of the telecommunication equipment is arranged in the top portion 530 of the light pole 100. The mid-portion 520 may be connected to the base portion 510 via a first connection (not shown), and the base portion 510 may furthermore be connected to the foundation 550 via a second connection (not shown). The streetlight arrangement 600 may hereby distribute light via the luminaire 610 whilst possessing a strong and 'smart' light pole 100, which is highly resistant to weather conditions, damage and/or tampering, and which may house pieces of telecommunication equipment 410 for wireless communication.

The person skilled in the art realizes that the present invention by no means is limited to the preferred embodiments described above. On the contrary, many modifications and variations are possible within the scope of the appended claims. For example, it will be appreciated that the figures are merely schematic views of light poles according to embodiments of the present invention. Hence, any elements/components of the light pole 100 such as the housing 110, the support structure 120, the board-shaped segment 130, the flanges 140*a*, 140*b*, etc., may have different dimensions, shapes and/or sizes than those depicted and/or described. For example, any elements/components may be larger or smaller than what is exemplified in the figures.

The invention claimed is:

1. A light pole extending along a principal axis, the light pole comprising:

a housing extending along the principal axis; and a support structure arranged within the housing, wherein the support structure comprises a board-shaped segment extending along the principal axis and flanges extending along the principal axis and arranged on at least one longitudinal side of the segment;

wherein the flanges, in a cross-section of the support structure perpendicular to the principal axis, extend in a plane perpendicular to the principal axis, and wherein the length of the flanges in said plane is larger at both end portions of the support structure than at a central portion of the support structure along the principal axis.

2. The light pole according to claim 1, wherein the length of the flanges in said plane and at intermediate portions located between the end portions and the central portion along the principal axis, is smaller than at the central portion.

3. The light pole according to claim 1, wherein the flanges are curved with respect to the principal axis such that the flanges at least partially enclose the principal axis.

4. The light pole according to claim 3, wherein the flanges are curved such that the flanges comprise circular arcs having centers coincide with the principal axis in a cross-section of the support structure perpendicular to the principal axis.

5. The light pole according to claim 4, wherein the length of the circular arcs in the cross-section of the support structure perpendicular to the principal axis is $\pi/3 \cdot r < L < \pi \cdot r$, wherein r is the radius of the circular arcs with respect to the principal axis and L is the length of the circular arcs.

6. The light pole according to claim 1, further comprising at least one piece of telecommunication equipment arranged within the housing and at least partially enclosed by the segment and the flanges of the support structure.

7. The light pole arrangement according to claim 6, wherein the housing further comprises at least a base portion and a top portion arranged along the principal axis, and wherein at least a portion of the at least one piece of telecommunication equipment is arranged in the base portion and wherein at least one antenna of the at least one piece of telecommunication equipment is arranged in the top portion.

8. The light pole arrangement according to claim 6, wherein the housing further comprises a mid-portion arranged between the base portion and the top portion, and wherein at least one of the mid-portion and the base portion comprises a first connection for connecting the mid-portion to the base portion.

9. The light pole arrangement according to claim 6, wherein the housing further comprises a foundation arranged below the base portion along the principal axis, and wherein at least one of the foundation and the base portion comprises a second connection for connecting the foundation to the base portion.

10. A streetlight arrangement, comprising:

a light pole arrangement according to claim 6, and at least one luminaire arranged at the top portion of the light pole.

* * * * *